United States Patent [19]

Leblanc et al.

[11] 4,452,574

[45] Jun. 5, 1984

[54] FUEL INJECTION PUMP

[75] Inventors: Jean Leblanc, Lyons; Francois Rossignol, Mornant; Jean Pierre Cigolotti, Chassieu, all of France

[73] Assignee: Robert Bosch GmbH, Stuttgart, Fed. Rep. of Germany

[21] Appl. No.: 421,176

[22] Filed: Sep. 22, 1982

[30] Foreign Application Priority Data

Jan. 15, 1982 [DE] Fed. Rep. of Germany ..... 3201011

[51] Int. Cl.[3] ..... F02M 59/44

[52] U.S. Cl. ..... 417/490; 74/55; 92/129; 417/501

[58] Field of Search ..... 123/495, 496, 508, 509, 123/90.49; 417/490, 494, 499, 498, 501; 239/88, 89, 90, 91, 92; 92/129; 74/55

[56] References Cited

U.S. PATENT DOCUMENTS

| | | | |
|---|---|---|---|
| 1,981,913 | 11/1934 | Fielden | 417/494 |
| 2,547,174 | 4/1951 | Rogers | 417/307 |
| 2,628,866 | 2/1953 | Purchas, Jr. et al. | 417/494 X |
| 2,890,657 | 6/1959 | May et al. | 417/494 |
| 2,935,878 | 5/1960 | Wirsching | 74/55 |
| 3,006,556 | 10/1961 | Shade et al. | 239/88 |
| 3,027,844 | 4/1962 | Kruk-Strzelecki | 417/499 |
| 3,276,760 | 10/1966 | Last et al. | 267/136 |

FOREIGN PATENT DOCUMENTS

| | | | |
|---|---|---|---|
| 1051835 | 1/1954 | France | 417/490 |

*Primary Examiner*—Leonard E. Smith
*Attorney, Agent, or Firm*—Edwin E. Greigg

[57] ABSTRACT

The fuel injection pump of this invention proposes at least one cylinder, a piston, a drive rod, a guide sleeve for the drive means, a guide conduit embracing the guide sleeve, a restoring spring for the drive rod and piston, said piston being designed to execute a suction stroke under the influence of the restoring spring. The injection pump also comprises a locking mechanism comprising a bearing which extends into two recesses. The one recess is in the form of an annular groove located in the guide conduit. The other recess is a slot formed in the guide sleeve in its longitudinal direction. The locking mechanism prevents the guide sleeve together with the rod and piston from falling out after the injection pump has been assembled. The locking mechanism is inexpensive and easy to assemble because it requires only a single bearing in addition to already existing components of the injection pump.

8 Claims, 5 Drawing Figures

FUEL INJECTION PUMP

BACKGROUND OF THE INVENTION

The present invention relates to a fuel injection pump for an internal combustion engine. U.S. Pat. No. 3,006,556 discloses an injection pump comprising a locking mechanism which holds a drive rod for a pump piston on the injection pump and prevents it from being lost when the injection pump is separated from a mechanical drive element such as a driving cam, for example, during servicing. This arrangement also prevents a restoring spring which also acts on the pump piston via the drive route from accidently pulling the piston out of its cylinder. This safety mechanism comprises a bolt with a molded locking lug within a bore extending transversely through the drive route. The locking lug engages in a slot-shaped recess which is located in a rod guide tube embracing the drive rod. The spring which is also disposed in the bore extending at right angles to the drive route keeps the locking lug in the slot-shaped recess. Both the bolt and the spring are prevented from being accidently released from the bore by means of a locking ring or locking disc. By reason of the fact that this safety mechanism consists of a number of parts it is costly to produce and difficult to assemble. Furthermore, the flat-shaped recess prevents the drive rod from rotating freely because it runs essentially parallel to the longitudinal access of the drive rod.

U.S. Pat. No. 2,819,657 discloses an injection pump in which a locking bolt is inserted in a recess bored transversely in a stationary guide tube and penetrates a slot extending in the longitudinal direction of a coupling sleeve surrounding the drive rod. The bolt has a complicated shape and is therefore costly and during assembly its pin-shaped end must be inserted first into the opening. This safety mechanism also prevents free rotation of the drive rod.

ADVANTAGES OF THE INVENTION

The injection pump revealed in the specification and finally claimed herein is inexpensive and because the locking elements is in the form of a bearing it can be assembled using simple means.

The characterizing features of claim 2 allow the drive rod and piston to be rotated about angles of any desired magnitude relative to the pump cylinder. The characterizing feature of claim 3 prevents dent depressions from being produced in the annular groove and thereby eliminates the risk of the drive rod being prevented from rotating freely. According to the feature of claim 4, when the bearing performs its locking function, no auxiliary means are required to keep it in a position in which its locking forces are exerted. The advantage of the embodiments comprising the features according to claims 5 and 6 and claims 5 and 7 is that the bearing is held in its appropriate recesses by existing essential pump components. The refinement claimed in claim 8 has a relatively short coupling sleeve.

The drawings show two embodiments of the invention. Further details of these embodiments are provided in the subsequent description.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
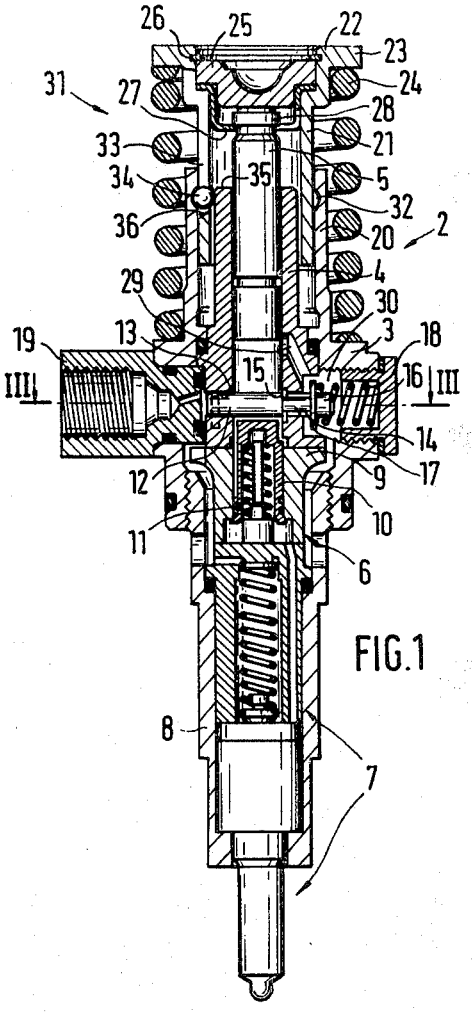
FIG. 1 is a longitudinal cross sectional view of a first embodiment.
Figure 2:
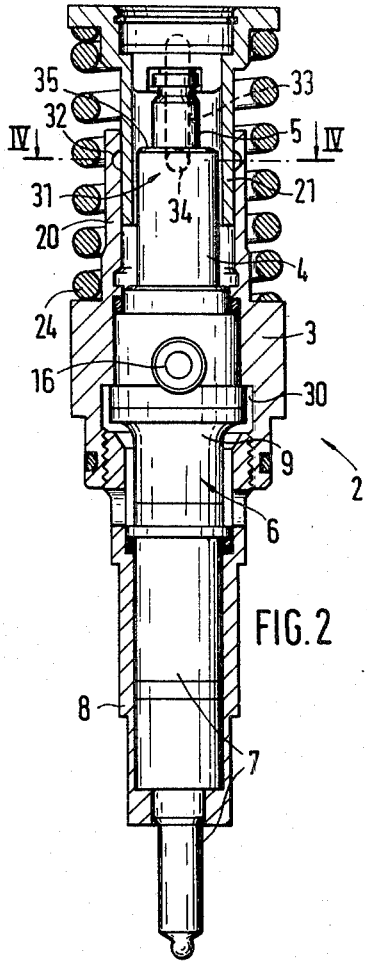
FIG. 2 is a second longitudinal cross sectional view of the embodiment according to FIG. 1.
Figure 3:
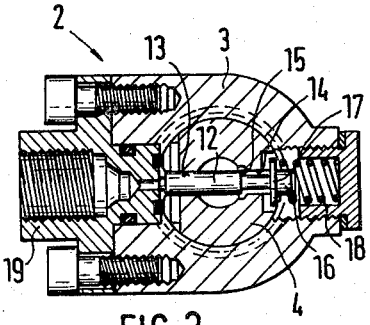
FIG. 3 is a cross sectional view on line III—III of FIG. 1.
Figure 4:
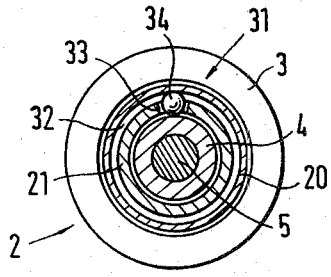
FIG. 4 is a cross sectional view on line IV—IV of FIG. 2.

The injection pump 2 shown in FIGS. 1–4 comprises a pump housing 3, a cylinder 4 inserted in the pump housing 3, a piston 5, a pressure valve 6 disposed beneath the pump cylinder 4, an injection nozzle 7 connected in series with the pressure valve 6 and a mounting sleeve 8 by means of which the injection nozzle 7, the pressure valve 6, and the cylinder 4 are held in the pump housing 3. The injection nozzle 7 corresponds to one disclosed in German Offenlegungsschrift No. 31 11 837. The pressure valve 6 comprises a pressure valve holder 9, a valve body 10 which is displaceable in the valve holder 9 and a closing spring 11. A valve spool 12 passes through the pump cylinder 4 between the pressure valve 6 and the piston 5. The valve spool 12 is longitudinally displaceable in a seal tight manner in a bore 13 extending transversely through the cylinder 4. Another bore 14 which forms a valve seat is disposed in an extension of the bore 13. The valve spool 12 has an annular closed control edge 15 which faces towards the bore 14. A spring support plate 17 is disposed on an end 16 of the valve spool 12; said end 16 projecting away from the bore 14. A spring 18 presses on this spring support plate 17 in the direction of the cylinder 4. The bore 13 is connected with a hydraulic control device (not shown) via a connection nipple 19. This control device is described in German Offenlegungschrift No. 31 11 837. It is used to control injection operations.

A guide conduit 20 is provided on the pump housing 3 and is concentrically disposed with respect to the cylinder 4. A guide sleeve 21 is mounted in a longitudinally displaceable manner in the guide conduit 20. The guide sleeve 21 comprises an outwardly projecting flange 23 on its end projecting from the guide conduit 20. A prestressed restoring spring 24 is inserted between this flange 23 and the housing 3. The end 22 receives a means 25 arranged to receive a drive rod 25 which is not shown said means being prevented from falling out of a locking ring 26. A coupling sleeve 27 is inserted in the guide sleeve 21. This coupling sleeve 27 grips beneath a collar 28 disposed on the piston 5 and thereby holds the piston 5 on the drive rod 25. The coupling sleeve 27 is inserted between the guide sleeve 21 and the drive rod 15 and is thus prevented from axial displacement. A mechanical drive element (not shown) acts on the drive means 25 in the direction of the piston 5. This mechanical drive element may consist, for example, of a push rod which is displaced in a known manner by a cam means driven by an internal combustion engine. The drive means 25 reciprocates the piston 5 within the cylinder 4. As a result, fuel which is sucked into the cylinder 4 via a suction opening 29 is subjected to pressure and depending on the position of the valve spool 12, it either flows back into a supply chamber 30 or it flows through the pressure valve 6 to the injection nozzle 7. A subsequent suction stroke is then produced as a result of the following operations: the restoring spring 24 raises the guide sleeve 21 via the flange 23, moves the drive means 25 towards the drive member and thus moves the piston 5 upwards within the cylinder 4 via the coupling sleeve 27.

The injection pump 2 comprises a locking mechanism 31. It consists of a recess 32 internally provided in the guide conduit 20, of a recess 33 provided in the guide sleeve 21, of a bearing 34 and of the upper end 35 of the pump cylinder 4. The bearing 34 projects both into the recess 32 and also into the recess 33. In the embodiment shown the recess 32 consists of an annular groove. The recess 33 is a slot which extends in the longitudinal direction of the guide sleeve 21. The end 35 of the cylinder 4 holds the bearing 34 in the recess 32. The length of the recess 33 is such that during normal operation of the pump 2 when the pump piston 5 reaches its maximum position at the end of a suction stroke its lower end does not touch the bearing 34. When the injection pump 2 is not mounted in an internal combustion engine the locking mechanism 31 prevents the guide sleeve 21 and thus the piston 5 from falling out of the injection pump 2. The locking mechanism 31 also performs this task during removal of the drive element (not shown) which acts on the drive means 25. The locking mechanism 31 also facilitates assembly of the internal combustion engine after insertion of the injection pump 2.

It is occasionally desirable between the end of one suction stroke and the subsequent pressure stroke of the injection pump to obtain a slight play between the drive means and the drive element acting upon it with the purpose of forming a lubricating film between said elements. In this event, a plurality of recesses 33 can be provided on the guide sleeve 21 and a plurality of bearings 34 can be inserted. When this is the case, the cross sections of the recesses 32 and the low end 36 of the recesses 33 are designed to perform closely to the radii of the bearings 34 to avoid dent depressions in the recesses 32 and 33 as a result of successive stroke limitations by the bearing 34. As a result of this conformity, the locking forces act essentially at acute angles relative to the longitudinal access of the injection pump 2. As a result, the sum of these forces is not substantially greater than the force of the restoring spring 24 and the inert forces of the injection pump components being displaced. A further advantage of adapting the lower ends 36 to the radii of the bearings 34 is that these do not exert disruptive forces on the end 35 of the cylinder 4. The groove 32 can be easily manufactured as a result of its configuration as an annular groove. The annular groove allows the guide sleeve 21 to rotate freely relative to the guide conduit 20. In the event that free rotatability about angles of any size is not required, the recess 32, respectively recesses, need only extend as an are of specific lengths. For example, the recess 32 may be in the form of a blind hole when it is undesirable for the bearing 34 to be displaced in the circumferential direction of the guide conduit 20.

Figure 5:
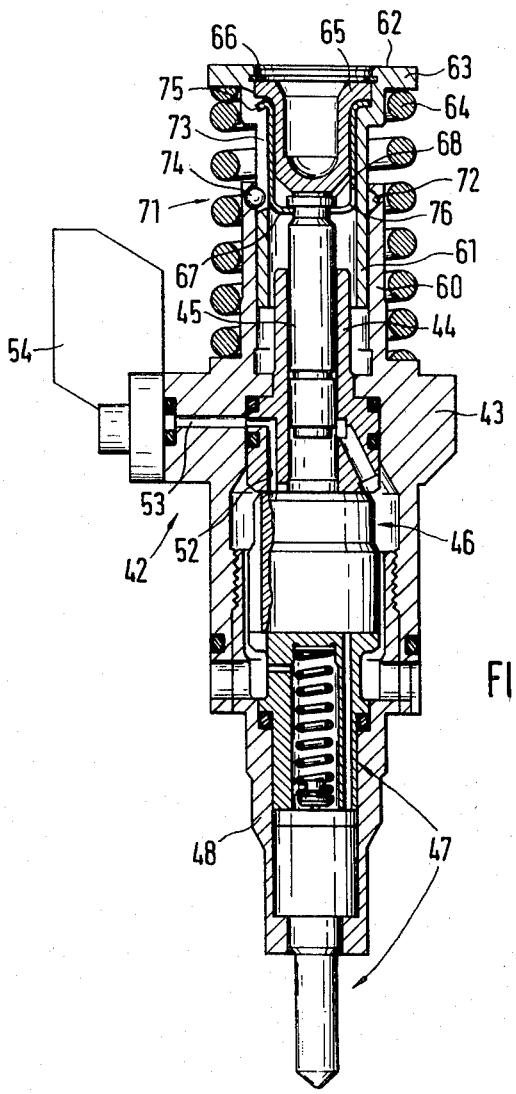
FIG. 5 is a longitudinal cross sectional view of a second embodiment.

The second embodiment of an injection pump 42 shown in FIG. 5 also comprises a pump housing 43, a cylinder 44, a piston 45, a pressure valve 46, an injection nozzle 47 and a securing sleeve 48. A discharge channel 52 which opens into the cylinder 44 is provided in place of a valve spool 12 extending through the cylinder 4 of the first embodiment. This discharge channel 52 is connected via another channel 53 which crosses the pump housing 43 with a fuel quantity control device 54. This fuel quantity control device is constructed similar to one described in U.S. Pat. No. 3,486,494 or German disclosure document No. 19 07 316. A guide conduit 60 is provided on the injection pump housing 43 concentrically with respect to the cylinder 44. A guide sleeve 61 is disposed in a longitudinally displaceable manner within the guide conduit. On its end 62 which projects from the guide conduit 60 the guide sleeve 61 comprises a radially outwardly directed flange 63. A prestressed restoring spring 64 is inserted between the flange 63 and the housing 43. At its end 62 the guide sleeve 61 receives a means 65 adapted to receive a drive rod. The drive means for the rod is prevented from falling out of a locking ring 66. A coupling sleeve 67 is inserted between the drive rod 65 and the guide sleeve 61. The coupling sleeve 67 grips beneath a collar 68 which is provided on the piston 45. It holds the piston 45 against the support means 65 for the drive rod via the collar 68. The injection pump 42 also comprises a locking mechanism 71. This locking mechanism 71 consists of a first recess 72 in the guide conduit 60, a second recess 73 in the guide sleeve 61 and a bearing 74. As in the first embodiment, the recess 72 can be in the form of an annular groove, an arched groove or a blind hole. The recess 73 is also a slot as in the first embodiment. When the recess 72 is in the form of an annular groove or an arched groove, the recess 73 is preferably disposed in the longitudinal direction of the guide sleeve 61. When the recess 72 is in the form of a blind hole, the slot-shaped recess 73 can be in the form of a course thread groove. The coupling sleeve 67 and the drive means 65 for the rod are longer than those of the first embodiment. The coupling sleeve 67 covers the recess sleeve 73 inwardly over its entire usable length. As a result, the coupling sleeve 67 serves as a lock element which prevents the bearing 74 from being released from the recess 73. The coupling sleeve 67 is equipped with an integral nose 75 to enable it to be as short as possible in spite of its locking function. This nose 75 engages in the recess 73 and prevents the coupling sleeve 77 from being rotated relative to the guide sleeve 61. As a result, the nose 75 prevents a recess 76 which is disposed in the lower end of the coupling sleeve 67 through which the collar 68 of the piston 45 is naturally inserted into the coupling sleeve 67 from coming into alignment with the bearing 74. This form of incorrect alignment would result in the bearing 74 leaving its appointed place both in the recess 72 and also the recess 73. As in the first embodiment the locking mechanism 71 can also be designed in such a way that a slight play is provided from time to time between a drive element (not represented) and the drive rod means 65 which support this play promoting formation of a lubricating film in a specific manner. Once this is the case a plurality of bearing recesses 74 and recesses 73 can be provided as described above.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. An injection pump comprising a pump housing, at least one cylinder and one piston in said cylinder, a drive means connected to said piston, said drive means further being displaceable in the direction of said cylinder and against a force of a restoring spring by means of a mechanical drive element, said pump housing further including a guide conduit, a guide sleeve connected to said drive means, said guide sleeve arranged to reciprocate and being guided in said guide conduit, a locking mechanism for said guide conduit and said guide sleeve said locking mechanism further including a locking element arranged to move in a first longitudinal recess in one of said guide sleeve and said guide conduit further caracterized in that said locking element comprises a bearing means which cooperates with a further curved recess which extends in a circumferential direction in the other of said guide conduit and said guide sleeve.

2. An injection pump as claimed in claim 1, characterized in that said further recess comprises an annular groove.

3. An injection pump as claimed in claim 1 or 2, characterized in that said further recess has a cross section defined by a radius which corresponds essentially to that of said bearing.

4. An injection pump as claimed in claim 1 or 2, characterized in that said first recess has an end extending in the longitudinal direction of said sleeve which is in the form of a seat adapted to the radius of said bearing.

5. An injection pump as claimed in claim 1 or 2, characterized in that said first recess extending in the longitudinal direction is in the form of a slot and is disposed in said guide sleeve and in that said further recess is disposed in said guide conduit.

6. An injection pump as claimed in claim 5, characterized in that said cylinder further comprises an end portion which extends toward said drive means and said end portion arranged to prevent said bearing from falling out of said further recess.

7. An injection pump as claimed in claim 5, characterized in that said drive means is associated with a coupling sleeve and said guide sleeve, said coupling sleeve being held against said piston and further arranged to cover said first longitudinal recess.

8. An injection pump as claimed in claim 7, characterized in that said coupling sleeve further comprises a nose which is inserted into said first recess of said guide sleeve and further that said piston includes a collar which is secured to said coupling sleeve by an offset means, and said piston arranged to be introduced into said offset means by a lateral insertion thereinto.

* * * * *